US005901955A

United States Patent [19]

Klopfenstein

[11] Patent Number: 5,901,955

[45] Date of Patent: May 11, 1999

[54] GRIPPER SEAT

[75] Inventor: Andrew L. Klopfenstein, Tipp City, Ohio

[73] Assignee: Heidelberg Finishing Systems, Inc., Dayton, Ohio

[21] Appl. No.: 08/719,996

[22] Filed: Sep. 25, 1996

[51] Int. Cl.[6] ..... B65H 5/02

[52] U.S. Cl. ..... 271/277; 271/82; 271/294; 101/409; 101/408; 101/410

[58] Field of Search ..... 271/277, 82, 294; 270/58.19, 58.23, 58.2; 101/408, 409, 410

[56] References Cited

U.S. PATENT DOCUMENTS

| | | | |
|---|---|---|---|
| 4,358,100 | 11/1982 | Muller | 271/11 |
| 4,592,279 | 6/1986 | Kemmerer | 271/82 |
| 4,721,296 | 1/1988 | Mowry . | |
| 4,723,770 | 2/1988 | Seidel et al. . | |
| 4,836,528 | 6/1989 | Geiser | 271/263 |
| 4,947,748 | 8/1990 | Hiltwein et al. | 101/409 |
| 5,255,605 | 10/1993 | Pfisterer | 271/206 |

FOREIGN PATENT DOCUMENTS

| | | | |
|---|---|---|---|
| 2175288 | 11/1986 | United Kingdom | 271/277 |

*Primary Examiner*—William E. Terrell
*Assistant Examiner*—Wonki Park
*Attorney, Agent, or Firm*—Tarolli, Sundheim, Covell, Tummino & Szabo

[57] ABSTRACT

A rotatable gripper drum includes a seat mounted on the drum and a gripper supported on the drum for pivotal movement relative to the seat between an open position and a closed position. The seat is made from a resilient material and includes a body portion having first and second grip surfaces. The drum has a retaining pocket for receiving the body portion of the seat to secure the seat for rotation with the drum. The seat is selectively mountable in the retaining pocket with the body portion in a first orientation in which the first grip surface cooperates with the gripper to grip sheet material or in a second orientation in which the second grip surface cooperates with the gripper to grip sheet material.

10 Claims, 2 Drawing Sheets

GRIPPER SEAT

BACKGROUND OF THE INVENTION

1. Technical Field

The present invention relates to a gripper seat for use in sheet material handling apparatus. In particular, the present invention relates to a gripper seat which is usable in two different orientations to extend the time before replacement of the gripper seat is necessary.

2. Description of the Prior Art

Known sheet material handling apparatus includes a rotatable gripper drum having a gripper drum which cooperates with a gripper seat to grip sheet material. The gripper seat can become worn after a period of operation of the gripper drum. When the gripper seat becomes worn, the worn gripper seat must be replaced with a new gripper seat.

SUMMARY OF THE INVENTION

The present invention is an apparatus for gripping sheet material, comprising a rotatable drum, a seat mounted on the drum and a gripper supported on the drum for pivotal movement relative to the seat between an open position and a closed position. The seat has first and second grip surfaces which cooperate with the gripper to grip sheet material. The drum has means for selectively securing the seat for rotation with the drum in a first orientation in which the first grip surface cooperates with the gripper to grip sheet material or in a second orientation in which the second grip surface cooperates with the gripper to grip sheet material.

In a preferred embodiment, the seat includes a body portion having the first and second grip surfaces and a guide tab projecting from the body portion. The drum has surface portions defining a retaining pocket for the body portion of the seat. The surface portions block movement of the body portion out of the retaining pocket to secure the seat for movement with the drum. The drum has a guide slot extending from the retaining pocket for receiving the guide tab of the seat when the body portion of the seat is received in the pocket. The guide tab of the seat is deformable to enable movement of the seat between the first and second orientations.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A PREFERRED EMBODIMENT OF THE INVENTION

Figure 1:
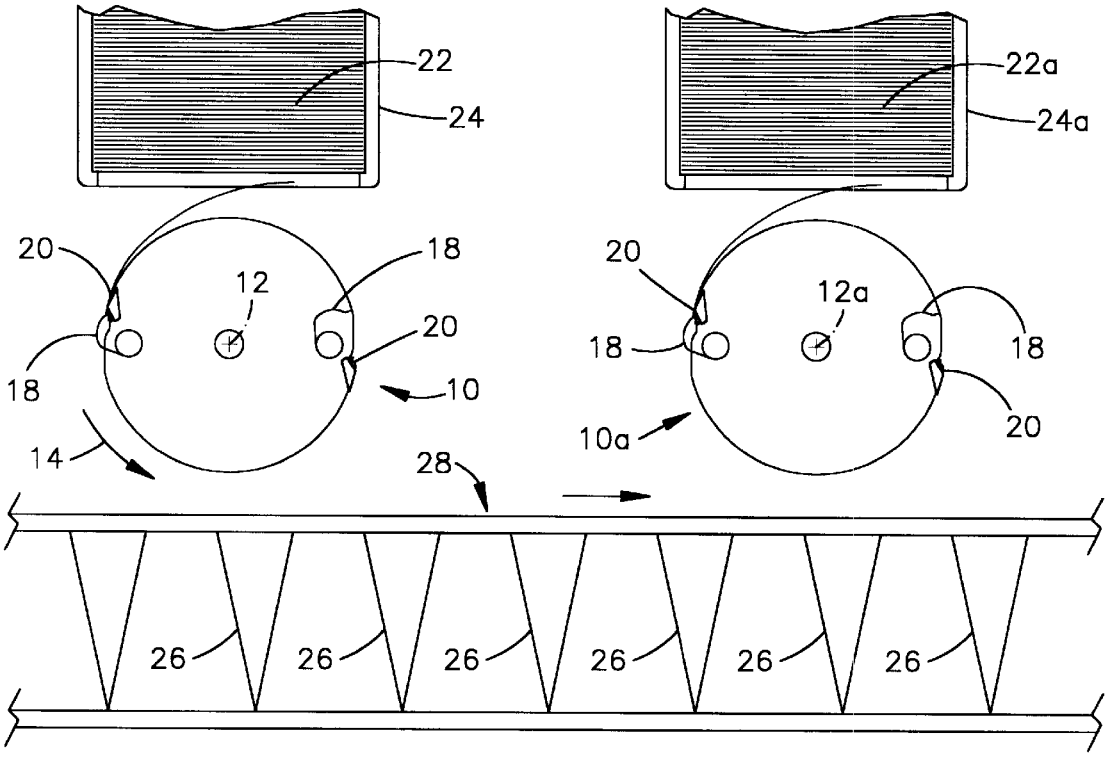
FIG. 1 is a schematic illustration of a signature collating apparatus including a gripper drum having a gripper and a gripper seat in accordance with the present invention.

The present invention relates to a gripper seat for use in sheet material handling apparatus. As representative of the present invention, FIG. 1 illustrates sheet material handling apparatus including a gripper drum 10. The gripper drum 10 is rotatable about an axis 12 in a direction indicated by the arrow 14, that is, counter-clockwise as viewed in FIG. 1. The gripper drum 10 includes a pair of grippers 18 and a pair of gripper seats 20. Each one of the grippers 18 cooperates with a respective gripper seat 20 to grip sheet material such as a signature 22 from a stack of signatures in a hopper 24. Each signature 22 is deposited in a pocket 26 in a collating conveyor 28 which moves past the gripper drum.

A second gripper drum 10*a*, identical to the gripper drum 10, is spaced along the collating conveyor 28 downstream from the gripper drum 10. The second gripper drum 10*a* grips signatures 22*a* from a second stack of signatures in a second hopper 24*a*. The signatures 22*a* from the second hopper 24*a* are deposited in the pockets 26 of the collating conveyor 28, with the signatures 22, as the pockets move past the second gripper drum 10*a*. In this manner, collated assemblages of signatures 22 and 22*a* are formed in the pockets 26.

Figure 4:
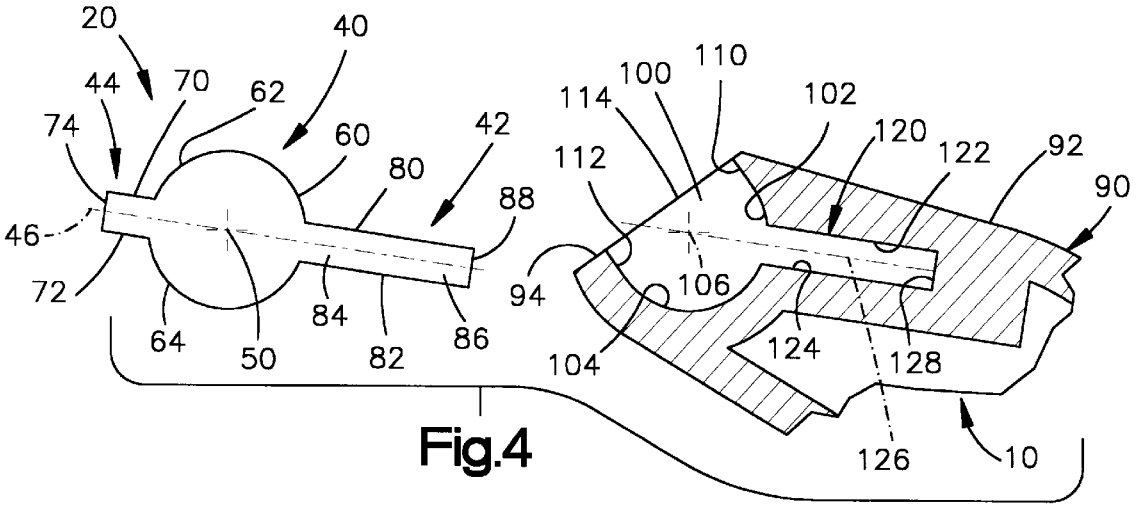
FIG. 4 is a further enlarged view of the gripper seat and a portion of the gripper drum.

The gripper seat 20 (FIG. 4) is molded as one piece from a resilient material such as urethane plastic. The gripper seat 20 has a main body portion 40, a guide tab 42, and a removal tab 44. The main body portion 40, the guide tab 42, and the removal tab 44 are centered on a central plane 46 of the gripper seat 20. The main body portion 40 of the gripper seat 20 has a cylindrical configuration centered on an axis 50 which extends into and out of the plane of the paper as viewed in the drawings. The axis 50 is located on the central plane 46 of the gripper seat 20.

The main body portion 40 of the gripper seat 20 has a cylindrical outer surface 60. A first cylindrical portion 62 of the outer surface 60 of the main body portion 40 of the gripper seat 20 forms a first grip surface on the gripper seat. A second cylindrical portion 64 of the outer surface 60 of the main body portion 40 of the gripper seat 20 forms a second grip surface on the gripper seat. The second grip surface 64 is disposed opposite the first grip surface 62, that is, on an opposite side of the central plane 46 of the gripper seat 20 from the first grip surface.

The removal tab 44 of the gripper seat 20 projects from the main body portion 40 in a first direction along the central plane 46. The removal tab 44 has a planar, rectilinear configuration including first and second opposite side surfaces 70 and 72. The first side surface 70 of the removal tab 44 merges with the first grip surface 62 of the main body portion 40 of the gripper seat 20. The second side surface 72 of the removal tab 44 merges with the second grip surface 64 of the main body portion 40 of the gripper seat 20. An end surface 74 of the removal tab 44 extends between and interconnects the first and second side surfaces 70 and 72 of the removal tab. The removal tab 44 of the gripper seat 20 is relatively short and rigid compared to the guide tab 42 of the gripper seat.

The guide tab 42 of the gripper seat 20 projects from the main body portion 40 in a direction opposite from the removal tab 44. The guide tab 42 has a planar, rectilinear configuration including first and second opposite side surfaces 80 and 82. The first side surface 80 of the guide tab 42 merges with the first grip surface 62 of the main body portion 40 of the gripper seat 20. The second side surface 82 of the guide tab 42 merges with the second grip surface 64 of the main body portion 40 of the gripper seat 20.

A first section 84 of the guide tab 42 is disposed adjacent to the main body portion 40 of the gripper seat 20. A second section 86 of the guide tab 42 is spaced apart from the main body portion 40. An end surface 88 of the guide tab 42 extends between and interconnects the first and second side surfaces 80 and 82 of the guide tab. The end surface 88 is formed on the second section 86 of the guide tab 42.

The thickness of the guide tab 42, that is, the distance between the surfaces 80 and 82, is the same as the thickness of the removal tab 44. The guide tab 42 is relatively long and bendable compared to the removal tab 44.

One gripper seat 20 constructed in accordance with the present invention has an overall length, between the end surfaces 74 and 88, of about 1.5 inches. The main body portion 40 of the one gripper seat 20 has a diameter of about 0.625 inches. The axis 50 of the main body portion 40 is located about 0.5 inches from the end surface 74 of the removal tab 44 and about 1.0 inches from the end surface 88 of the guide tab 42. The removal tab 44 and the guide tab 42 each have a thickness of about 0.16 inches. The one gripper seat 20 has a width (as measured in a direction into and out of the paper as viewed in the drawings) of about 0.875 inches.

The gripper drum 10 has a portion 90 for supporting the gripper seat 20 for rotation with the gripper drum about the axis 12. The portion 90 of the gripper drum 10 has an outer side surface 92 and a planar face surface 94. The gripper drum portion 90 may be a part of the drum 10 itself, or may be a separate piece secured for rotation with the gripper drum. For example, the portion 90 may comprise part of an articulating arm mounted on the gripper drum 10 for pivotal movement relative to the gripper drum.

The portion 90 of the gripper drum 10 defines a retaining pocket 100 for the main body portion 40 of the gripper seat 20. The retaining pocket 100 has a generally cylindrical configuration defined by first and second cylindrical surfaces 102 and 104. The cylindrical surfaces 102 and 104 are centered on a common axis 106 which extends into and out of the plane of the paper as viewed in the drawings. The cylindrical surfaces 102 and 104 have the same radius of curvature as the cylindrical outer surface 60 of the main body portion 40 of the gripper seat 20.

The cylindrical surfaces 102 and 104 together extend for 180° around the axis 106. A first planar surface or flat 110 extends outward from the first cylindrical surface 102 to intersect at a 90° angle the face surface 94. A second planar surface or flat 112 extends outward from the second cylindrical surface 104 to intersect at a 90° angle the face surface 94.

The flats 110 and 112 extend parallel to each other and define an insertion passage 114 into the retaining pocket 100. The width of the passage 114, that is, the distance between the flats 110 and 112, is approximately the same as the diameter of the main body portion 40 of the gripper seat 20. The width of the passage 114 is substantially greater than the thickness of the removal tab 44.

A planar guide slot 120, for receiving the guide tab 42 of the gripper seat 20, extends from the retaining pocket 100 into the gripper drum 10. The guide slot 120 has a rectilinear configuration defined by first and second opposite side surfaces 122 and 124 spaced equidistant from a central plane 126 of the guide slot. The first side surface 122 of the guide slot 120 merges with the first cylindrical surface 102 of the retaining pocket 100. The second side surface 124 of the guide slot 120 merges with the second cylindrical surface 104 of the retaining pocket 100. An end surface 128 of the guide slot 120 extends between and interconnects the first and second side surfaces 122 and 124 of the guide slot.

To assemble the gripper seat 20 with the gripper drum 10, the guide tab 42 on the gripper seat is inserted through the retaining pocket 100 in the gripper drum and into the guide slot 120. The main body portion 40 of the gripper seat 20 moves through the passage 114, between the flats 110 and 112, and into the retaining pocket 100.

Figure 5:
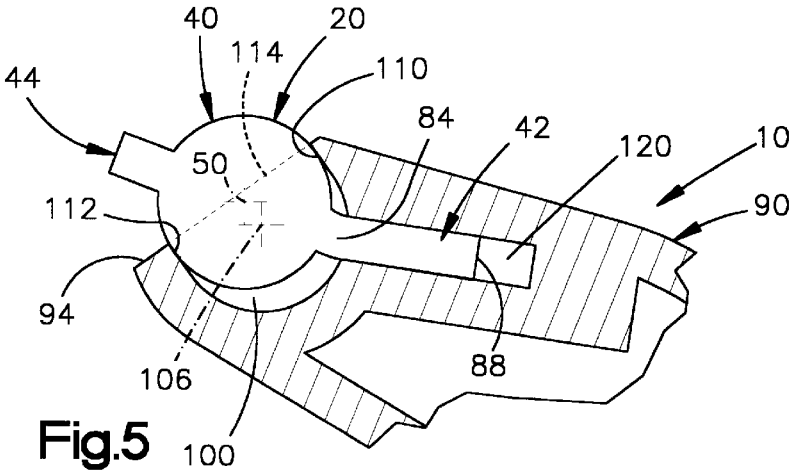
FIG. 5 is a view similar to FIG. 4 illustrating a step in the assembling of the gripper seat with the gripper drum.

Because the guide slot 120 does not extend parallel to the flats 110 and 112, the guide tab 42 bends or deforms as seen in FIG. 5 during insertion of the main body portion 40 of the gripper seat 20 into the retaining pocket 100. Thus, the guide tab 42 moves into the guide slot 120 in a direction parallel to the central plane 126 of the guide slot, while the main body portion 40 of the gripper seat 20 moves into the retaining pocket 100 in a transverse direction which is parallel to the flats 110 and 112.

When the main body portion 40 of the gripper seat 20 is fully received in the retaining pocket 100, the main body portion pivots relative to the guide tab 42. The guide tab 42 straightens, from the condition shown in FIG. 5 to the condition shown in FIG. 6. The axis 50 of the main body portion 40 of the gripper seat 20 is located on the axis 106 of the retaining pocket 100 of the gripper drum 10.

Figure 6:
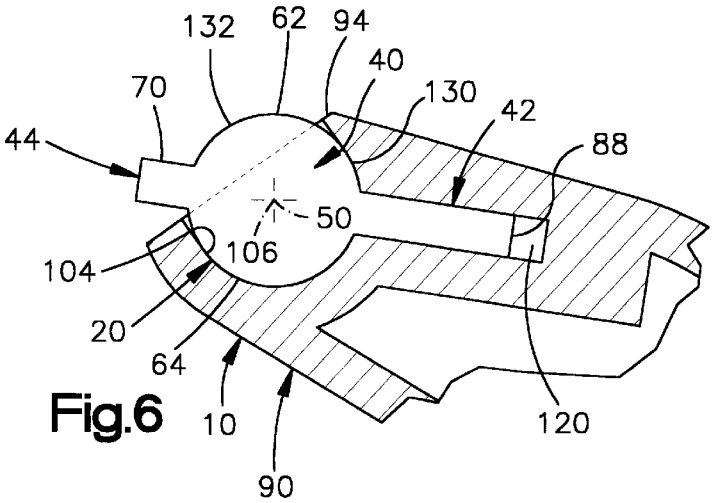
FIG. 6 is a view similar to FIG. 5 showing the gripper seat in a position assembled with the gripper drum.

When the gripper seat 20 is in the assembled condition shown in FIG. 6, the second cylindrical surface 104 on the gripper drum 10 blocks movement of the main body portion 40 of the gripper seat out of the retaining pocket 100 in the gripper drum 10. The resilience of the guide tab 42 prevents the main body portion 40 of the gripper seat 20 from moving back to a condition, as shown in FIG. 5, in which the main body portion can be removed from the retaining pocket 100. The gripper seat 20 is thus securely held in a first orientation in the retaining pocket 100 in the gripper drum 10.

When the gripper seat 20 is secured in the first orientation in the gripper drum 10, the second grip surface 64 of the gripper seat 20 is in abutting engagement with the second cylindrical surface 104 of the retaining pocket 100. A part 130 of the first grip surface 62 of the gripper seat 20 is in abutting engagement with the first cylindrical surface 102 of the retaining pocket 100. Another part 132 of the first grip surface 62 of the gripper seat 20 is exposed between the face surface 94 on the gripper drum 10 and the first side surface 70 on the removal tab 44.

Figure 2:
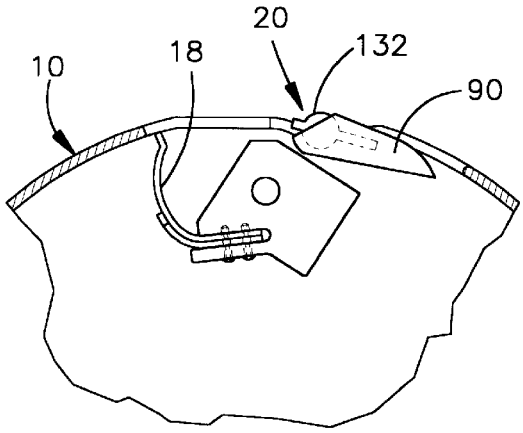
FIG. 2 is an enlarged view of a portion of the gripper drum, showing the gripper in an open position.
Figure 3:
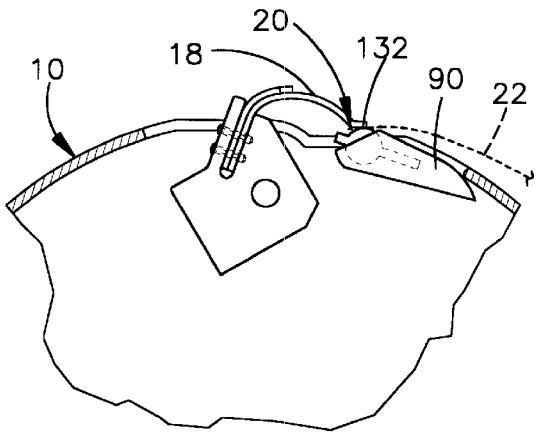
FIG. 3 is a view similar to FIG. 2 showing the gripper in a closed position.

During operation of the gripper drum 10, the gripper 18 has an open position spaced apart from the gripper seat 20, as seen in FIG. 2. The gripper 18 is movable in a known manner, from the position shown in FIG. 2 to the position shown in FIG. 3, to grip a signature 22 against the exposed part 132 of the first grip surface 62 of the gripper seat 20.

After a period of operation of the apparatus 10, the exposed part 132 of the first grip surface 62 of the gripper seat 20 may become worn. The gripper seat 20 can then be manually removed and inverted as described below to place the gripper seat 20 in a second orientation (not shown). When the gripper seat 20 is in the second orientation, a part of the second grip surface 64 is exposed.

The removal and re-orientation operation is the reverse of the insertion operation described above. Specifically, to remove the gripper seat 20, the removal tab 44 is manually grasped and moved upward as viewed in FIG. 6. The main body portion 40 of the gripper seat 20 pivots relative to the guide tab 42 as the first section 84 of the guide tab 42 deforms. The removal tab 44 is pulled outwardly so as to pull the main body portion 40 of the gripper seat 20 out of the retaining pocket 100 through the channel 114 between the flats 110 and 112. The guide tab 42 follows. The removal and subsequent re-assembly of the gripper seat 20 are made easier because no fasteners are needed to secure the gripper seat in the drum 10.

After the gripper seat 20 is removed from the gripper drum 10, the gripper seat 20 is inverted and replaced in the gripper drum in the second orientation. When the gripper seat 20 is in the second orientation, the first grip surface 62 of the gripper seat is in abutting engagement with the second cylindrical surface 104 of the retaining pocket 100. A part of the second grip surface 64 of the gripper seat 20 is in abutting engagement with the first cylindrical surface 102 of the retaining pocket 100. Another part of the second grip surface 64 of the gripper seat 20 is exposed to the gripper 18. During subsequent operation of the gripper drum 10, the gripper 18 is movable to grip a signature 22 against the exposed part of the second grip surface 64 of the gripper seat 20.

From the above description of the invention, those skilled in the art will perceive improvements, changes and modifications. For example, it may be desirable to provide a plurality of gripper seats made from materials having different hardnesses. Gripper seats of different hardnesses can be color coded, to indicate hardness by color. Such improvements, changes and modifications within the skill of the art are intended to be covered by the appended claims.

Having described the invention, I claim:

1. A gripper drum assembly for gripping sheet material, comprising:

a rotatable drum;

a seat mounted on said drum; and a gripper supported on said drum for pivotal movement relative to said seat between an open position and a closed position;

said seat including a body portion having first and second opposite grip surfaces and a guide tab projecting from said body portion;

said drum having surface portions defining a retaining pocket for said body portion of said seat, said surface portions blocking movement of said body portion out of said retaining pocket to secure said seat for movement with said drum;

said drum having a guide slot extending from said retaining pocket for receiving said guide tab of said seat when said body portion of said seat is received in said pocket;

said seat being mountable on said drum with said body portion in a first orientation in which said first grip surface is engageable by said gripper and being formed of a resilient material;

said guide tab of said seat being deformable to enable movement of said body portion of said seat out of said retaining pocket to enable reorientation of said seat on said drum;

said seat being mountable on said drum with said body portion in a second orientation in which said second grip surface is engageable by said gripper.

2. An apparatus as set forth in claim 1 wherein said seat comprises a removal tab which is fixed for movement with said body portion of said seat, said removal tab projecting from said body portion of said seat in a direction opposite said guide tab, said removal tab being manually engageable to enable movement of said seat between the first and second orientations.

3. An apparatus for gripping sheet material, comprising:

a rotatable drum;

a seat mounted on said drum; and a gripper supported on said drum for pivotal movement relative to said seat between an open position and a closed position;

said seat having first and second grip surfaces which cooperate with said gripper to grip sheet material and being formed of a resilient material;

said drum having means for selectively securing said seat for rotation with said drum in a first orientation in which said first grip surface cooperates with said gripper to grip sheet material or in a second orientation in which said second grip surface cooperates with said gripper to grip sheet material;

said means for securing said seat comprising a pocket in said drum and a guide slot in said drum extending from said pocket, said seat having a body portion receivable in said pocket and a guide tab which extends from said body portion and which is receivable in said guide slot;

said drum comprising a passage extending between said pocket and an outer surface of said drum in a direction transverse to said guide slot, said body portion of said seat being movable through said passage into said pocket during insertion of said seat into said drum and during removal of said seat from said drum, said means for securing said seat blocking movement of said body portion of said seat through said passage when said seat is in the first orientation and when said seat is in the second orientation.

4. An apparatus as set forth in claim 3 wherein said passage extends between said retaining pocket and an outer surface of said drum, said body portion and said guide tab moving relative to each other during removal of said body portion from said pocket in said drum.

5. An apparatus as set forth in claim 3 wherein said gripper seat is made from a resilient material and said body portion of said seat is resiliently movable relative to said guide tab during movement of said seat between the first and second orientations.

6. An apparatus as set forth in claim 5 wherein said body portion of said seat has a generally cylindrical configuration on which said first grip surface and said second grip surface are formed, said guide tab having a generally planar configuration.

7. A gripper drum assembly for gripping sheet material, comprising:

a rotatable drum;

a seat mounted on said drum; and a gripper supported on said drum for pivotal movement relative to said seat between an open position and a closed position;

said seat being made from a resilient material and including a body portion having first and second grip surfaces;

said drum having a retaining pocket for receiving said body portion of said seat, said pocket being defined by surfaces of said drum which hold said seat in said pocket to secure said seat for rotation with said drum;

said seat being resiliently deformable between a first condition in which said seat is blocked from movement out of said retaining pocket by said surfaces in said drum and a second condition in which said seat is removable from said retaining pocket;

said seat when in the first condition being selectively mountable in said retaining pocket with said body portion in a first orientation in which said first grip surface cooperates with said gripper to grip sheet material or in a second orientation in which said second grip surface cooperates with said gripper to grip sheet material.

8. An apparatus as set forth in claim 7 wherein said seat includes a guide tab extending from said main body portion, said guide tab being resiliently deformed when said seat is in the second condition thereby enabling movement of said main body portion of said seat into said retaining pocket.

9. An apparatus as set forth in claim 8 wherein said drum comprises a guide slot extending from said pocket, said guide tab being receivable in said guide slot, said drum comprising a passage extending between said retaining pocket and an outer surface of said drum at an angle relative to said guide slot, said body portion of said seat being movable through said passage when said seat is resiliently deformed into said second condition, said means for securing said seat blocking movement of said body portion of said seat through said passage when said seat is in the first condition.

10. An apparatus as set forth in claim 8 wherein said seat comprises a removal tab extending from said main body portion in a direction generally opposite said guide tab, said removal tab being manually engageable to transmit force to said body portion of said seat to deform said guide tab and move said seat from the first condition to the second condition.

* * * * *